US009840096B2

(12) United States Patent
Sakano et al.

(10) Patent No.: US 9,840,096 B2
(45) Date of Patent: Dec. 12, 2017

(54) TAPE CARTRIDGE

(71) Applicant: Seiko Epson Corporation, Tokyo (JP)

(72) Inventors: Hideki Sakano, Suwa (JP); Hideo Sodeyama, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/128,307

(22) PCT Filed: Mar. 19, 2015

(86) PCT No.: PCT/JP2015/058313
§ 371 (c)(1),
(2) Date: Sep. 22, 2016

(87) PCT Pub. No.: WO2015/146793
PCT Pub. Date: Oct. 1, 2015

(65) Prior Publication Data

US 2017/0106678 A1 Apr. 20, 2017

(30) Foreign Application Priority Data

Mar. 24, 2014 (JP) ..... 2014-060912

(51) Int. Cl.
*B41J 15/04* (2006.01)
*B41J 3/407* (2006.01)

(52) U.S. Cl.
CPC ..... *B41J 15/044* (2013.01); *B41J 3/4075* (2013.01)

(58) Field of Classification Search
CPC ..... B41J 29/026; B41J 29/023; B41J 29/02; B41J 29/00; B41J 15/044; B41J 3/4075
See application file for complete search history.

(56) References Cited

U.S. PATENT DOCUMENTS 5,595,447 A 1/1997 Takayama et al.
5,788,387 A 8/1998 Takayama et al.
(Continued)

FOREIGN PATENT DOCUMENTS

JP H07-214828 8/1995
JP H10-157210 6/1998
(Continued)

OTHER PUBLICATIONS

Search Report received in International Application No. PCT/JP2015/058313, dated Jun. 16, 2015.

*Primary Examiner* — Kristal Feggins
(74) *Attorney, Agent, or Firm* — ALG Intellectual Property, LLC

(57) ABSTRACT

A tape cartridge is installed detachably on a cartridge installation portion of a tape printing apparatus in a predetermined detachable direction. The tape printing apparatus includes a detection portion which detects closing of an opening/closing cover provided on the cartridge installation portion. The tape cartridge includes a displacement input portion. When the opening/closing cover is displaced from an open state to a closed state in a state where the tape cartridge is installed on the cartridge installation portion, the displacement input portion receives displacement of a detection-target element provided on the opening/closing cover to be displaced according to the displacement of the opening/closing cover, and the displacement output portion actuates a detection element of the detection portion according to displacement of the opening/closing cover to be further displaced in the same direction from the open state to the closed state.

18 Claims, 12 Drawing Sheets

(56) References Cited

U.S. PATENT DOCUMENTS

| | | | |
|---|---|---|---|
| 6,126,344 | A | 10/2000 | Takayama et al. |
| 6,386,774 | B1 | 5/2002 | Takayama et al. |

FOREIGN PATENT DOCUMENTS

| | | |
|---|---|---|
| JP | H10-157237 | 6/1998 |
| JP | H10-217563 | 8/1998 |
| JP | 2011-046142 | 3/2011 |
| JP | 2012-152951 | 8/2012 |

TAPE CARTRIDGE

CROSS-REFERENCE TO RELATED APPLICATIONS

This application is the U.S. National Phase under 35 U.S.C. §371 of International Application No. PCT/JP2015/058313 filed on Mar. 19, 2015, which in turn claims the benefit of Japanese Application No. 2014-060912 filed on Mar. 24, 2014, the disclosures of which are expressly incorporated by reference herein.

TECHNICAL FIELD

The present invention relates to a tape cartridge that is used by being installed on a cartridge installation portion in a tape printing apparatus to be used, and is subjected to printing by the tape printing apparatus.

BACKGROUND ART

In the related arts, a tape accommodating cassette provided with three projections corresponding to tape-width sensors of a printer (tape printing apparatus) has been known as such a tape cartridge (see JP-7-214828).

In the printer, an installation portion of the tape accommodating cassette is provided with tape-width sensors configured with photo interrupters to respectively detect three projections. The tape-width sensors detect the presence or absence of three projections, respectively, and thus detects a tape width of a printing tape mounted in the tape accommodating cassette. In addition, the printer includes a cassette cover that opens/closes the installation portion of the tape accommodating cassette and a small mechanical switch that is provided at a position away from the installation portion and detects opening/closing of the cassette cover.

SUMMARY

In such a printer (tape printing apparatus) of the related art, the mechanical switch for detecting the opening/closing of the cassette cover (opening/closing cover) is provided at the position away from the installation portion. That is, since it is hindered by the tape accommodating cassette (tape cartridge) mounted on the installation portion, the mechanical switch is inevitably provided at the position away from the installation portion. For this reason, there are problems that the size of the cassette cover becomes large and an installation position of the mechanical switch is restricted. In addition, during the detection by the tape-width sensors, the tape width of the printing tape and the installation of the tape accommodating cassette (tape cartridge) can be simultaneously detected by three projections. In the tape accommodating cassette not having three projections, however, a state where the tape accommodating cassette is not installed is also detected, and thus there is a problem that the tape width cannot be detected when three projections are not present.

An object of the present invention is to provide a tape cartridge capable of detecting not only closing of an opening/closing cover but also the presence or absence of the tape cartridge in a tape printing apparatus.

A tape cartridge of the present invention is a tape cartridge installed detachably on a cartridge installation portion of a tape printing apparatus in a predetermined detachable direction, the tape printing apparatus including a detection portion which detects closing of an opening/closing cover provided on the cartridge installation portion, the tape cartridge including a displacement input portion, and a displacement output portion. Wherein, when the opening/closing cover is displaced from an open state to a closed state in a state of being installed on the cartridge installation portion, the displacement input portion receives displacement of a detection-target element, which is provided on the opening/closing cover, to be displaced according to the displacement of the opening/closing cover from the open state to the closed state, and the displacement output portion actuates a detection element of the detection portion according to displacement of the opening/closing cover to be further displaced in the same direction from the open state to the closed state.

With such a configuration, the displacement input portion receives the displacement of the detection-target element, which is provided on the opening/closing cover, according to the closing of the opening/closing cover, and the displacement output portion actuates the detection element of the detection portion according to such displacement. That is, the detection-target element of the opening/closing cover actuates the detection element of the detection portion through the displacement input portion and the displacement output portion. Accordingly, the presence of the tape cartridge is also detected by the detection of the closing of the opening/closing cover using the detection portion, and thus the closing of the opening/closing cover and the presence or absence of the tape cartridge can be simultaneously detected.

In this case, preferably, the tape cartridge further includes: a cartridge casing that has a shell structure, an accommodation opening that is provided in the cartridge casing and accommodates the detection-target element; and an insertion opening that is provided in the cartridge casing and into which the detection element is inserted, and the displacement input portion and the displacement output portion are disposed inside the cartridge casing.

With such a configuration, it is possible to provide the displacement input portion and the displacement output portion without changing the contour of the cartridge casing.

In this case, preferably, a position of the displacement input portion coming in contact with the detection-target element is positionally deviated from a position of the displacement output portion coming in contact with the detection element when viewed in the detachable direction.

With such a configuration, it is possible to appropriately actuate the detection element according to the closing of the opening/closing cover even when the detection-target element is hardly disposed coaxially with the detection element due to the restriction on installation places.

In this case, preferably, the tape cartridge further includes a displacement portion that includes the displacement input portion and the displacement output portion, the displacement portion is displaced substantially around a support point, and a distance from the support point to the position of the displacement output portion coming in contact with the detection element is longer than a distance from the support point to the position of the displacement input portion coming in contact with the detection-target element.

With such a configuration, since the displacement of the detection-target element is transmitted with expansion, the detection element can be reliably actuated even when an actuation stroke of the detection element becomes long.

In the same manner, preferably, the tape cartridge further includes a displacement portion that includes the displacement input portion and the displacement output portion, the displacement portion is displaced substantially around a support point, and a distance from the support point to the position of the displacement output portion coming in contact with the detection element is shorter than a distance from the support point to the position of the displacement input portion coming in contact with the detection-target element.

With such a configuration, the pressing force of the detection-target element for causing the displacement of the displacement portion can be reduced, and the force to be applied at the time of the closing of the opening/closing cover can be reduced.

Preferably, the displacement portion has an elastic portion that is subjected to elastic deformation by a pressing force of the detection-target element and actuates the detection element by the elastic deformation.

With such a configuration, due to the elastic deformation of the elastic portion, the cartridge casing may be resiliently pressed by the detection-target element. Thus, the cartridge casing is fixedly positioned in the cartridge installation portion. Accordingly, it is possible to simultaneously detect the closing of the opening/closing cover and the presence or absence of the tape cartridge, and to achieve the positioning of the tape cartridge.

In this case, preferably, the elastic portion includes an elastic piece that comes in contact with the detection-target element and extends toward the detection element in an "L" shape.

In this case, preferably, the tape cartridge further includes a cartridge casing that has a shell structure, and the elastic piece is formed integrally with the cartridge casing.

In the same manner, preferably, the tape cartridge further includes a cartridge casing that has a shell structure, and the elastic piece is configured with a plate spring supported on the cartridge casing.

With such a configuration, it is possible to form the elastic piece with a simple structure. In addition, as the elastic portion is formed in the "L" shape toward the detection element, the protrusion size of the detection element from the cartridge installation portion can be shortened.

Preferably, the displacement portion includes: an input elastic portion that is subjected to elastic deformation by a pressing force of the detection-target element; and an output actuation portion that is continuous to the input elastic portion and actuates the detection element according to the elastic deformation of the input elastic portion.

With such a configuration, the output actuation portion becomes longer, and thus it is possible to shorten the detection-target element protruding from the opening/closing cover and to shorten the detection element protruding toward the cartridge installation portion.

In this case, preferably, the tape cartridge further includes a cartridge casing that has a shell structure, and the input elastic portion is formed by removing a part of a casing wall of the cartridge casing.

In this case, preferably, the input elastic portion is formed by removing a part of a casing wall in a "U" shape.

With such a configuration, it is possible to form the input elastic portion by molding, machining, or the like in a very simple manner. That is, the input elastic portion can be formed with a very simple structure.

Meanwhile, preferably, the tape cartridge further includes a cartridge casing that has a shell structure, the cartridge casing has two casing, and the displacement portion is provided on either one of the two casing.

With such a configuration, when there is an existing tape cartridge having the same shape, it is possible to simply manufacture the tape cartridge having the displacement portion only by design change of one casing.

In addition, preferably, the tape cartridge further includes a displacement portion that includes the displacement input portion and the displacement output portion, and the displacement portion includes an input portion that moves by a pressing force of the detection-target element and an output portion that is continuous to the input portion and actuates the detection element according to movement of the input portion.

With such a configuration, the output actuation portion becomes longer, and thus it is possible to shorten the detection-target element protruding from the opening/closing cover and to shorten the detection element protruding toward the cartridge installation portion. In addition, it is possible to stably actuate the detection element by the movement of the input portion.

In this case, preferably, the input portion and the output portion are integrally formed.

With such a configuration, the displacement portion can be formed with a simple structure.

In addition, preferably, the displacement portion further includes an elastic member that receives the input portion at an initial position at which the detection-target element is received.

With such a configuration, due to the elastic deformation of the elastic portion, the cartridge casing may be resiliently pressed by the detection-target element. Thus, the cartridge casing is fixedly positioned in the cartridge installation portion.

In this case, preferably, the elastic member is configured with a coil spring.

In the same manner, preferably, the elastic member is configured with either one of rubber and sponge.

In the same manner, preferably, the elastic member is a casing piece formed in such a manner that a part of a casing wall of the cartridge casing is cut and raised toward the input portion.

With such a configuration, the elastic member can be formed with a very simple structure.

DESCRIPTION OF EXEMPLARY EMBODIMENTS

Hereinafter, a description will be given, with reference to the accompanying drawings, of a tape cartridge according to an embodiment of the present invention in conjunction with a tape printing apparatus in which the tape cartridge is installed. The tape printing apparatus is used to perform printing while feeding out a printing tape and an ink ribbon from the installed tape cartridge and cut off a printed part of the printing tape to create a label (tape piece).

[Outline of Tape Printing Apparatus]

Figure 1:
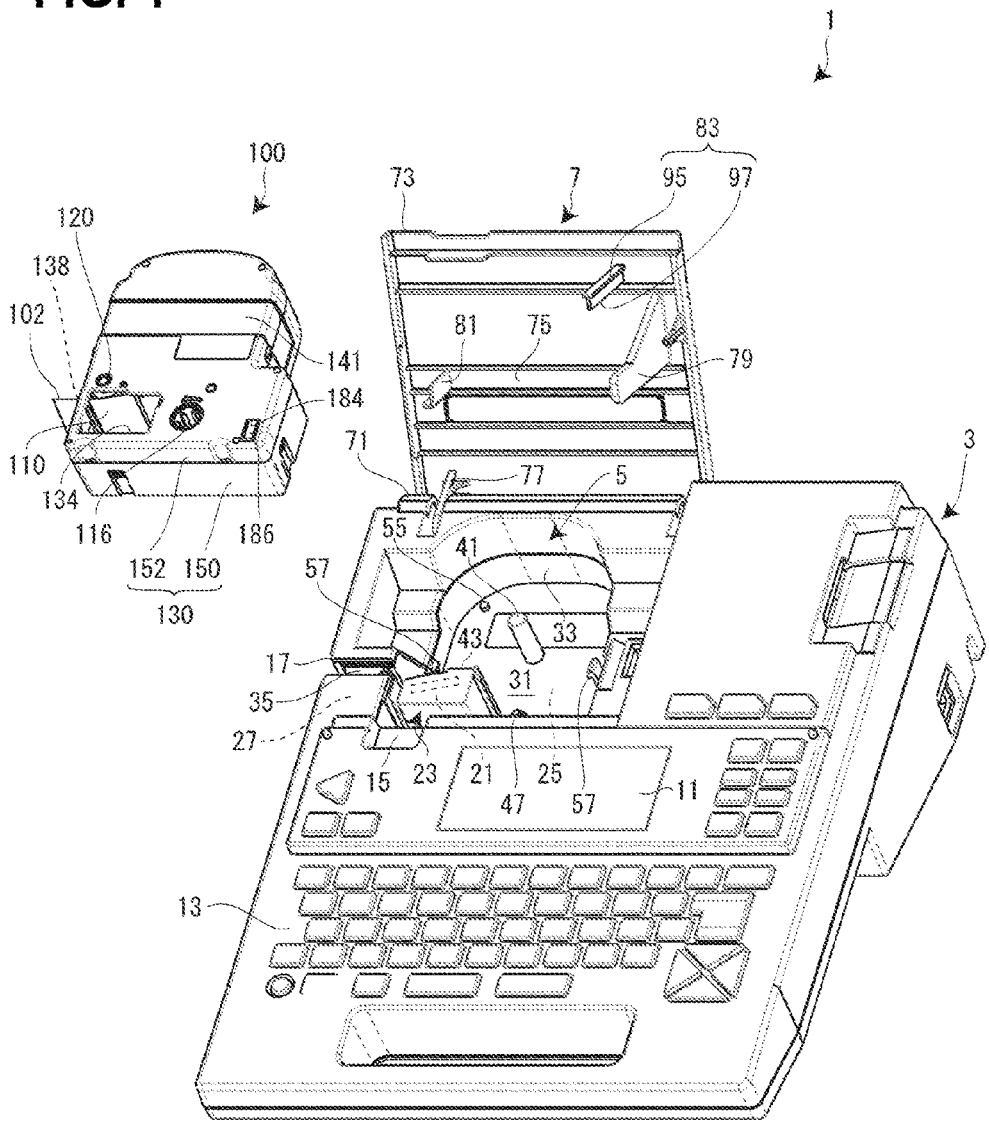
FIG. 1 is an external perspective view of a cover open condition of a tape printing apparatus according to an embodiment.

FIG. 1 is an external perspective view of the tape printing apparatus and the tape cartridge installed in the tape printing apparatus. As illustrated in the same figure, a tape printing apparatus 1 includes an apparatus casing 3 constituting an outer shell, a cartridge installation portion 5 on which a tape cartridge 100 is detachably installed, and an opening/closing cover 7 used to open/close the cartridge installation portion 5. At the upper surface of the apparatus casing 3, the cartridge installation portion 5 is provided on the back side, a display 11 is provided on the central side, and a keyboard 13 is provided on the front side. In the vicinity of the opening/closing cover 7, a finger-hooking recessed portion 15 is provided. The opening/closing cover 7 is opened so as to be flipped up through the recessed portion 15. On the side surface (left side surface) of the apparatus casing 3, an elongated tape ejection port 17 is provided to eject a printing tape 102.

In addition, the tape printing apparatus 1 includes a printing mechanism portion 23 having a printing head 21 provided uprightly on the cartridge installation portion 5, a tape feeding mechanism portion 25 embedded in the back side space of the cartridge installation portion 5, and a tape cutting mechanism portion 27 embedded in the vicinity of the tape ejection port 17. A user inputs printing information using the keyboard 13 and performs printing with a key operation after confirming the printing information on the display 11. Upon the printing instruction, the tape feeding mechanism portion 25 is driven to make the printing tape 102 and the ink ribbon 110 run parallel to each other, and printing is performed by heat transfer from the printing mechanism portion 23. By the print feeding, the printing tape 102 is ejected from the tape ejection port 17. When the printing is completed, the tape cutting mechanism portion 27 is driven, whereby a printed part of the printing tape 102 is separated.

[Outline of Tape Cartridge]

Figure 2A:
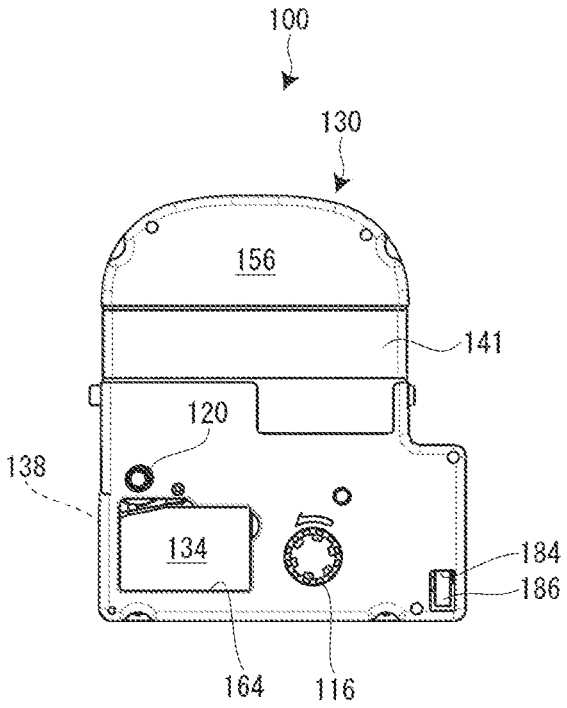
FIGS. 2A and 2B are a plan view and a side view of a tape cartridge according to the embodiment.
Figure 2B:
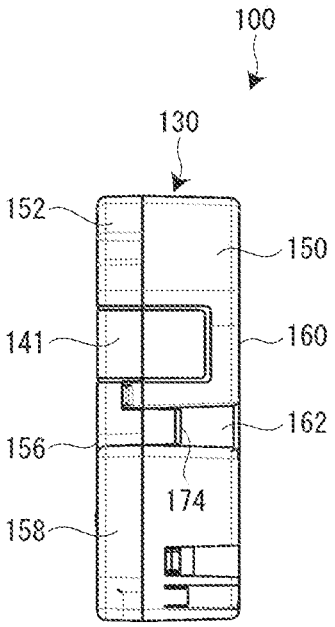

As illustrated in FIGS. 1, 2A, and 2B, the tape cartridge 100 includes a tape roll 106 in which the printing tape 102 is wound on a tape core 104 and a ribbon roll 114 in which the ink ribbon 110 is wound on a feeding-out core 112. In addition, the tape cartridge 100 includes a winding-up core 116 that winds up the ink ribbon 110 that has been consumed and a platen roller 120 (platen) that comes in contact with the printing head 21 and feeds the printing tape 102 and the ink ribbon 110. Moreover, the tape cartridge 100 includes a cartridge casing 130 that accommodates the tape roll 106, the ribbon roll 114, the winding-up core 116, and the platen roller 120. As described above, the tape cartridge 100 of this embodiment has so-called a shell structure in which the outer shell is covered with the cartridge casing 130.

Further, the tape cartridge 100 includes an insertion opening 134, into which the printing head 21 is inserted when the tape cartridge is installed in the tape printing apparatus 1, on the cartridge casing 130. The tape cartridge 100 includes a delivered 138 from which the printing tape 102 is delivered. Note that as will be described in detail below, the tape roll 106 is rotatably supported on a cylindrical core shaft 192 projecting inside the cartridge casing 130.

When the platen roller 120 and the winding-up core 116 are driven by the tape feeding mechanism portion 25, the printing tape 102 is fed out from the tape core 104 and the ink ribbon 110 is fed out from the feeding-out core 112. The fed-out printing tape 102 and the ink ribbon 110 run parallel to each other at the platen roller 120 and are subjected to printing by the printing head 21. A fed-out end (printed part) of the printing tape 102, on which the printing has been performed, is delivered from the delivered 138 to the tape ejection port 17. On the other hand, the ink ribbon 110 goes around the peripheral wall part of the insertion opening 134 and is wound up on the winding-up core 116. Note that a plurality of types of tape cartridges having a different thickness is available as the tape cartridge 100 according to a tape width of the printing tape 102.

[Details of Tape Printing Apparatus]

Figure 3:
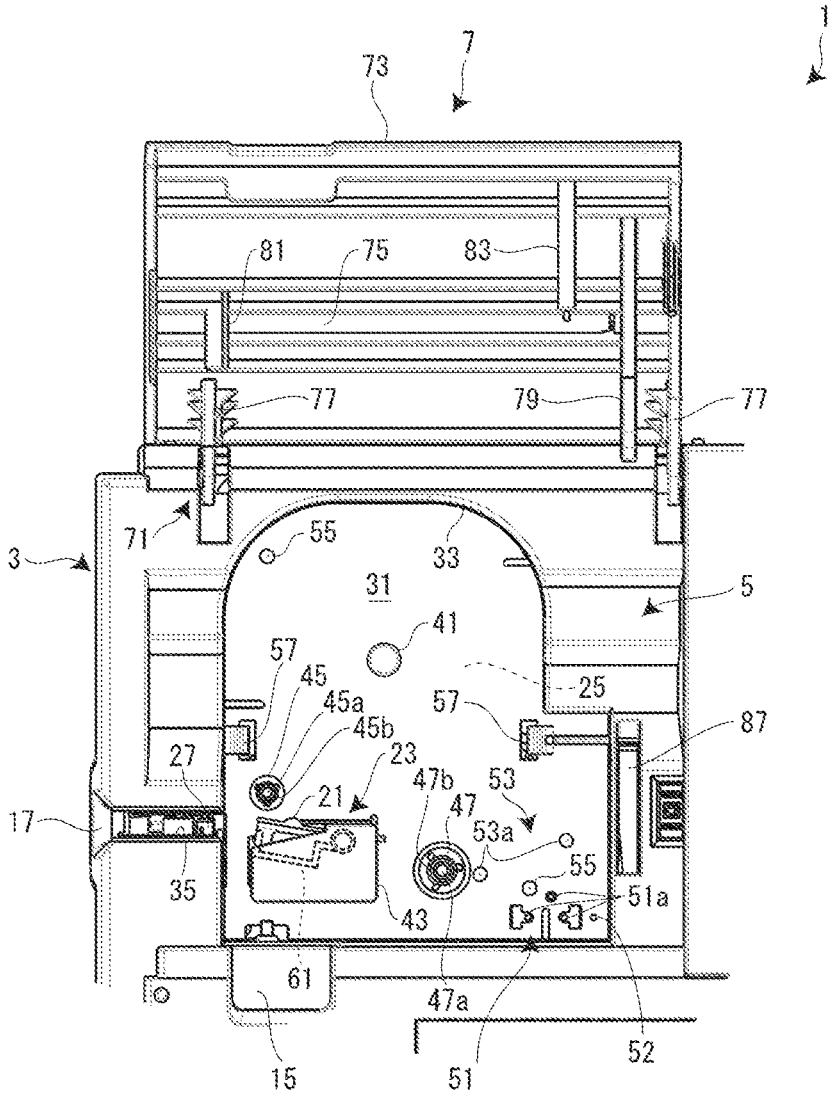
FIG. 3 is a plan view of a cartridge installation portion.

As illustrated in FIGS. 1 and 3, the cartridge installation portion 5 is formed in a flat shape complementary to the flat shape of the tape cartridge 100 and formed to be recessed with a depth corresponding to the tape cartridge 100 having a maximum thickness among the plurality of types of tape cartridges 100. In this case, an installation base 31 constituting the bottom plate portion of the cartridge installation portion 5 and a side plate portion 33 are integrally formed (molded) by a resin or the like. A slit-shaped tape ejection path 35 is formed between the cartridge installation portion 5 and the tape ejection port 17, and the tape cutting mechanism portion 27 is embedded at this part.

In the installation base 31 of the cartridge installation portion 5, when the tape cartridge 100 is installed, a positioning projection 41 into which the core shaft 192 of the tape cartridge 100 is fitted and positioned, the printing head 21 covered with the head cover 43, a platen driving shaft 45 that rotates and drives the platen roller 120, a winding-up driving shaft 47 that rotates and drives the winding-up core 116 are provided uprightly. In addition, the installation base 31 is provided with a tape detection portion 51 that detects type (attribute information) of the printing tape 102, cover detection portion 52 that detects closing of the opening/closing cover 7, and a core releasing portion 53 that releases the rotation-stop of the feeding-out core 112 and the winding-up core 116 which are positioned in the vicinity of the winding-up driving shaft 47, respectively (see FIG. 3).

Furthermore, the installation base 31 is provided with a pair of small projections 55 at positions diagonal to each other, and is additionally provided with a pair of retaining pieces 57 that retain an intermediate portion of the installed tape cartridge 100. In the back side space of the installation base 31, the tape feeding mechanism portion 25 having a motor and a gear train (both of them is not illustrated in the drawings) to rotate the platen driving shaft 45 and the winding-up driving shaft 47 is embedded. The tape feeding mechanism portion 25 branches power using the gear train, and synchronously rotates the platen driving shaft 45 and the winding-up driving shaft 47.

The printing mechanism portion 23 includes the printing head 21 constituted of a thermal head and a head support frame 61 that supports and rotates the printing head 21. In addition, the printing mechanism portion 23 includes a head releasing mechanism (not illustrated) that rotates the printing head 21 between a printing position and a retracting position through the head support frame 61 and the head cover 43 that covers the printing head 21 (and the head support frame 61).

The head releasing mechanism operates as the opening/closing cover 7 is opened/closed. The head releasing mechanism moves (rotates) the printing head 21 to the printing position according to the closing operation of the opening/closing cover 7 and moves (rotates) the printing head 21 to the retracting position according to the opening operation thereof. The printing head 21 comes in contact with the platen roller 120 of the tape cartridge 100 through the ink ribbon 110 and the printing tape 102 when moving to the printing position and separates from the platen roller 120 when moving to the retracting position. Thus, the printing tape 102 and the ink ribbon 110 are prevented from interfering with the printing head 21 when the tape cartridge 100 is attached to or detached from the tape printing apparatus 1.

The printing head 21 is provided with a plurality of heat generation elements, and the plurality of heat generation elements lines up in the same direction as the shaft direction of the platen roller 120. Further, printing is performed when the printing tape 102 and the ink ribbon 110 are fed and the plurality of heat generation elements is selectively driven. The head cover 43 is formed in a substantially rectangle shape in plan view and integrally formed (molded) with the installation base 31 (the cartridge installation portion 5). In addition, the head cover 43 vertically largely projects from the installation base 31. The head cover 43 internally allows the rotation of the printing head 21 and externally functions as an installation guide for the tape cartridge 100.

The tape detection portion 51 is constituted of a plurality of micro switches 51*a*, selectively engages with a detection target 180, which will be described later, of the tape cartridge 100, and detects a type such as a tape width, a tape color, and a material of the printing tape 102. Further, based on the detection result, the driving of the printing head 21 and the tape feeding mechanism portion 25 is controlled.

Figure 7A:
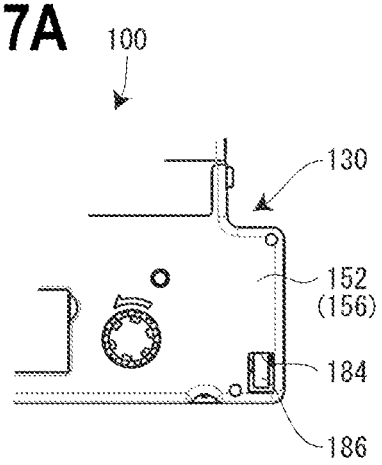
FIGS. 7A, 7B, and 7C are, respectively, an enlarged plan view of a surrounding displacement portion, an enlarged perspective view of a surrounding detection-target projection, and a cross-sectional view of a surrounding displacement portion of a tape cartridge according to a first embodiment.
Figure 7B:
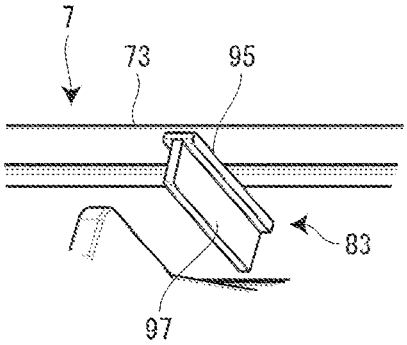
Figure 7C:
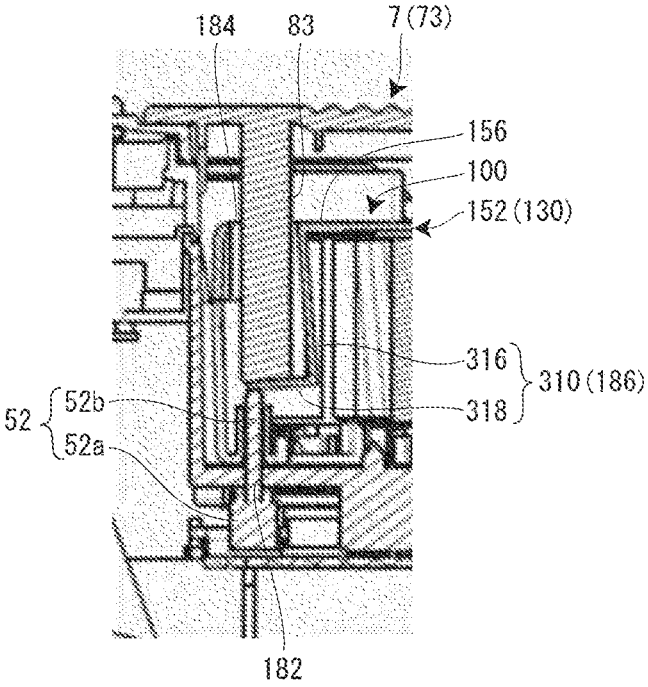

The cover detection portion 52 is configured with a push switch including a detection portion body 52*a* and a rod-like detection element 52*b*, and is disposed such that the detection element 52*b* protrudes into the cartridge installation portion 5 from the installation base 31 (see FIG. 7C). When the cover detection portion 52 actuates (turns ON) and the closing of the opening/closing cover 7 is detected, a process such as printing can be achieved. In the cover detection portion 52, the detection portion body 52*a* may be configured with an optical sensor or the like.

The core releasing portion 53 is constituted of two releasing pins 53*a* for the feeding-out core 112 and the winding-up core 116. As will be described in detail later, the cartridge casing 130 is provided with rotation-stop hooks 206 retained by the feeding-out core 112 and the winding-up core 116, respectively (see FIG. 6). When the tape cartridge 100 is installed, the releasing pins 53*a* engage with the rotation-stop hooks 206 to release the rotation-stop of the feeding-out core 112 and the winding-up core 116.

The platen driving shaft 45 includes a fixation shaft 45*a* provided so as to insert the platen roller 120, and a spline-like movable shaft 47*a* rotatably journaled in the base of the fixation shaft 45*a*. The rotation power of the tape feeding mechanism portion 25 is transmitted to the movable shaft 45*b* and then further transmitted to the platen roller 120 from the movable shaft 45*b*. Similarly, the winding-up driving shaft 47 includes a fixation shaft 47*a* and a spline-like movable shaft 47*b* rotatably journaled in the fixation shaft 47*a*. In this case as well, the rotation power of the tape feeding mechanism portion 25 is transmitted to the movable shaft 47*b* and then further transmitted from the movable shaft 47*b* to the winding-up core 116.

When the tape cartridge 100 is installed on the cartridge installation portion 5, the core shaft 192 (the tape core 104) engages with the positioning projection 41, the platen roller 120 engages with the platen driving shaft 45, and the winding-up core 116 engages with the winding-up driving shaft 47. Then, when the opening/closing cover 7 is closed, the printing head 21 rotates and comes in contact with the platen roller 120 with the printing tape 102 and the ink ribbon 110 held therebetween, which brings the tape printing apparatus 1 in a printing standby state.

Figure 4:
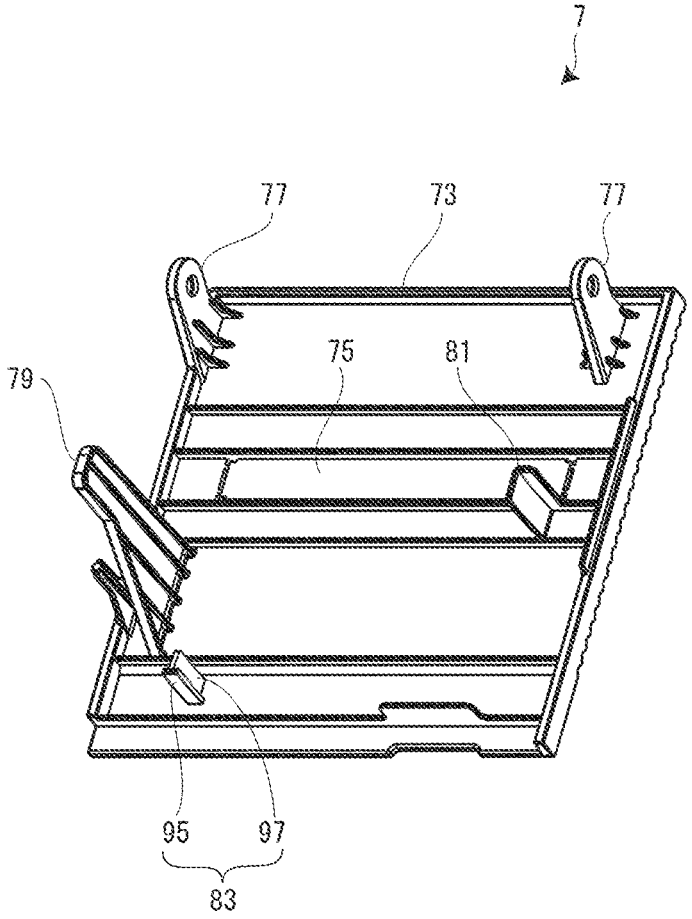
FIG. 4 is a perspective view of an opening/closing cover when viewed from a back side.

As illustrated in FIGS. 1 and 4, the opening/closing cover 7 is rotatably, i.e., openably/closably attached to the apparatus casing 3 through a hinge portion 71 provided on the back side. The opening/closing cover 7 includes an opening/closing cover main body 73 and a check window 75 provided at the center of the opening/closing cover main body 73. In addition, opening/closing cover 7 includes a pair of journaled pieces 77 that projects from the rear surface of the opening/closing cover main body 73 and is rotatably journaled in the hinge portion 71 and an actuation lever 79 that projects from the rear surface of the opening/closing cover main body 73 and rotates the printing head 21. Moreover, the opening/closing cover 7 includes a pressing projection 81 that projects from the rear surface of the opening/closing cover main body 73 and press the tape cartridge 100 and a detection-target projection 83 (detection-target element) that projects from the rear surface of the opening/closing cover main body 73 and operates (turns ON) the cover detection portion 52.

The check window 75 is formed to be long from side to side and made of a transparent (visible-light transparent) resin formed separately from the opening/closing cover main body 73. Through the check window 75, (a type and a tape remaining amount of the printing tape 102 of) the tape cartridge 100 installed on the cartridge installation portion 5 can be visually checked. In addition, the pair of journaled pieces 77, the actuation lever 79, the pressing projection 81, and the detection-target projection 83 are formed (molded) integrally with the opening/closing cover main body 73 by a resin.

The actuation lever 79 largely projects from the rear surface of the opening/closing cover main body 73 and is inserted in a slit opening 87 provided on the lateral side of the cartridge installation portion 5 as the opening/closing cover 7 is closed. The actuation lever 79 inserted in the slit opening 87 causes the head releasing mechanism described above to operate and the printing head 21 to rotate forward the platen roller 120. The pressing projections 81 is positioned so as to be in the vicinity of the platen roller 120 of the tape cartridge 100, and presses the tape cartridge 100 so as to be seated on the installation base 31 of the cartridge installation portion 5 with the closing of the opening/closing cover 7.

The detection-target projection 83 is disposed in the vicinity of the actuation lever 79, and vertically protrudes from the rear surface of the opening/closing cover body 73. In addition, the detection-target projection 83 is formed in a cross-sectional "T" shape, and is disposed with a flange piece 95 directed to the side of the tip end of the opening/closing cover body 73 and a rib piece 97 directed to the side of the base end of the opening/closing cover body 73 (details will be described below). Although details will be described below, the detection-target projection 83 is inserted into the tape cartridge 100 with the closing of the opening/closing cover 7, and actuates (turns ON) the cover detection portion 52 through the displacement portion 186 of the tape cartridge 100.

[Details of Tape Cartridge]

Next, a description will be given in detail of the tape cartridge 100 with reference to FIGS. 2A, 2B, 5A, 5B, and 6. Note that in the description of the tape cartridge 100, taking FIGS. 2A and 2B as an example, a surface on the near side in the installation direction, i.e., on the upper front side of the tape cartridge 100 will be called a "front surface", a surface on the back side in the installation direction, i.e., on the opposite side of the tape cartridge 100 will be called a "rear surface", a side surface on the left side of the tape cartridge 100 will be called a "left side surface", a side surface on the right side thereof will be called a "right side surface", an arc-like side surface on the upper side (front side) thereof will be called a "tip end surface", and a side surface on the lower side (rear side) thereof will be called a "base end surface".

As described above, the tape cartridge 100 includes the cartridge casing 130 and the tape roll 106, the ribbon roll 114, the winding-up core 116, and the platen roller 120 accommodated in the cartridge casing 130. In addition, the tape cartridge 100 includes the insertion opening 134 provided on the cartridge casing 130, the delivered 138 formed on the left side surface in the vicinity of the platen roller 120, and an identification label 141 (see FIG. 1) affixed from the left side surface to the right side surface through the front surface at a position at which the tape roll 106 is accommodated. On the identification label 141, a tape width, a tape color, a material, and the like (some of attribute information) of the printing tape 102 accommodated in the cartridge casing 130 are displayed at the two places of the front surface and the left side surface.

The cartridge casing 130 constitutes the outer shell of the tape cartridge 100 (the shell structure) and has an appearance that is formed in an "L"-shape in plan view and of which the base end at the right side surface slightly projects. In the front and rear direction, the cartridge casing 130 is constituted of a lower casing 150 and an upper casing 152, the lower casing 150 and the upper casing 152 being positioned on the back side and the near side, respectively, when the cartridge casing 130 is installed on the cartridge installation portion 5. In the cartridge casing 130 of the embodiment, the upper casing 152 is constituted of a transparent resin molded item, and the lower casing 150 is constituted of a non-transparent resin molded item.

The upper casing 152 is such that a top wall portion 156 constituting the front surface of the cartridge casing 130 and an upper peripheral wall portion 158 suspending on the periphery of the top wall portion 156 are integrally formed (molded). In addition, the lower casing 150 is such that a bottom wall portion 160 constituting the rear surface of the cartridge casing 130, a lower peripheral wall portion 162 provided to stand on the periphery of the bottom wall portion 160, and an opening peripheral wall portion 164 provided to stand on the bottom wall portion 160 so as to define the insertion opening 134 are integrally formed (molded).

On the lower end surface of the upper peripheral wall portion 158 of the upper casing 152, a plurality of joining pins 170 is provided at appropriate intervals. While, on the lower peripheral wall portion 162 of the lower casing 150, a plurality of joining holes 172 is provided corresponding to the plurality of joining pins 170 (see FIGS. 5A and 5B). After constituents such as the tape roll 106 and the ribbon roll 114 are disposed on the lower casing 150, the upper casing 152 is joined to the lower casing 150 so as to press-fit the plurality of joining pins 170 in the plurality of joining holes 172, whereby the tape cartridge 100 is assembled. Note that the respective joining holes 172 are formed as through holes from the viewpoint of molding easiness.

Figure 6:
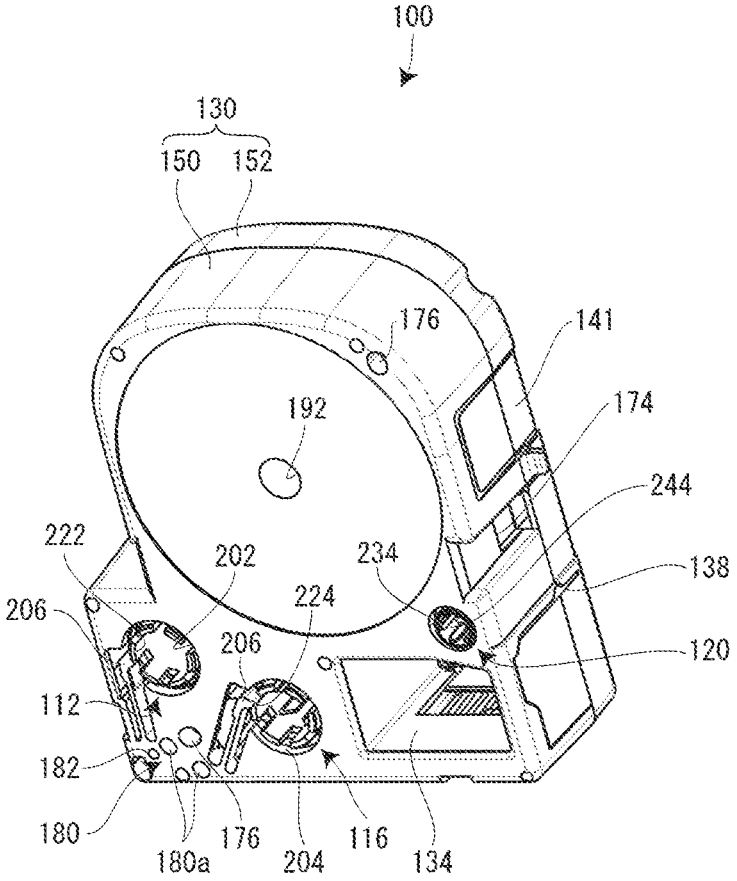
FIG. 6 is a perspective view of the tape cartridge when viewed from the back side.

On the other hand, on the left side surface and the right side surface of the lower casing 150, a pair of retaining-reception portions 174 retained by the pair of retaining pieces 57 is provided (see FIGS. 2A and 2B and FIG. 6). When the pair of retaining-reception portions 174 of the installed tape cartridge 100 is retained by the pair of retaining pieces 57 on the side of the cartridge installation portion 5, the tape cartridge 100 is prevented from floating. In addition, on the rear surface of the lower casing 150, small fitting holes 176 in which the pair of small projections 55 fits with slight room are provided (see FIG. 6). When the pair of small projections 55 on the side of the cartridge installation portion 5 fits in the pair of small fitting holes 176 of the installed tape cartridge 100, the tape cartridge 100 is easily positioned on the installation base 31.

Moreover, on the rear surface (bottom wall portion 160) of the lower casing 150, the detection target 180 corresponding to the detection portion 51 is provided at a left corner (right corner as viewed from the front surface side) on the side of the base end surface (see FIG. 6). The detection target 180 is constituted at a place corresponding to the plurality of micro switches 51*a* of the tape detection portion. 51, and a plurality of bit patterns is obtained based on the presence or absence of reception holes 180*a* provided at the portion. That is, the bit patterns correspond to a type of the printing tape 102.

In addition, on the rear surface (bottom wall portion 160) of the lower casing 150 is formed with a circular insertion opening 182, into which the detection element 52*b* of the cover detection portion 52 is loosely inserted, in the vicinity of the detection target 180 (see FIG. 6). As described above, the detection element 52*b* is provided on the cartridge installation portion 5 so as to protrude from installation base 31, and the detection element 52*b* is inserted into the tape cartridge 100 from the insertion opening 182 when the tape cartridge 100 is installed on the cartridge installation portion 5.

On the other hand, at the right corner on the side of the base end surface in the front surface (top wall portion 156) of the tape cartridge 100, that is, at the right corner on the side of the base end surface in the front surface of the upper casing 152, an accommodation opening 184 into which the detection-target projection 83 is inserted and a displacement portion 186 coming in contact with the detection-target projection 83 inserted from the accommodation opening 184 are provided (see FIGS. 2A, 2B, 5A, and 5B). Although details will be described below, when the opening/closing cover 7 is closed, the detection-target projection 83 provided on the opening/closing cover 7 is inserted into the tape cartridge 100 from the accommodation opening 184, and thus presses the displacement portion 186. The pressed displacement portion 186 is elastically deformed, thereby generating an elastic force. The tape cartridge 100 receives the opening/closing cover 7 by the elastic force, and is pressed against the cartridge installation portion 5 (installation base 31). At the same time, due to the elastically deformed displacement portion 186, the detection element 52*b* inserted into the insertion opening 182 is pressed down, and thus the cover detection portion 52 actuates (turns ON) (details will be described below).

Figures 5A, 5B:
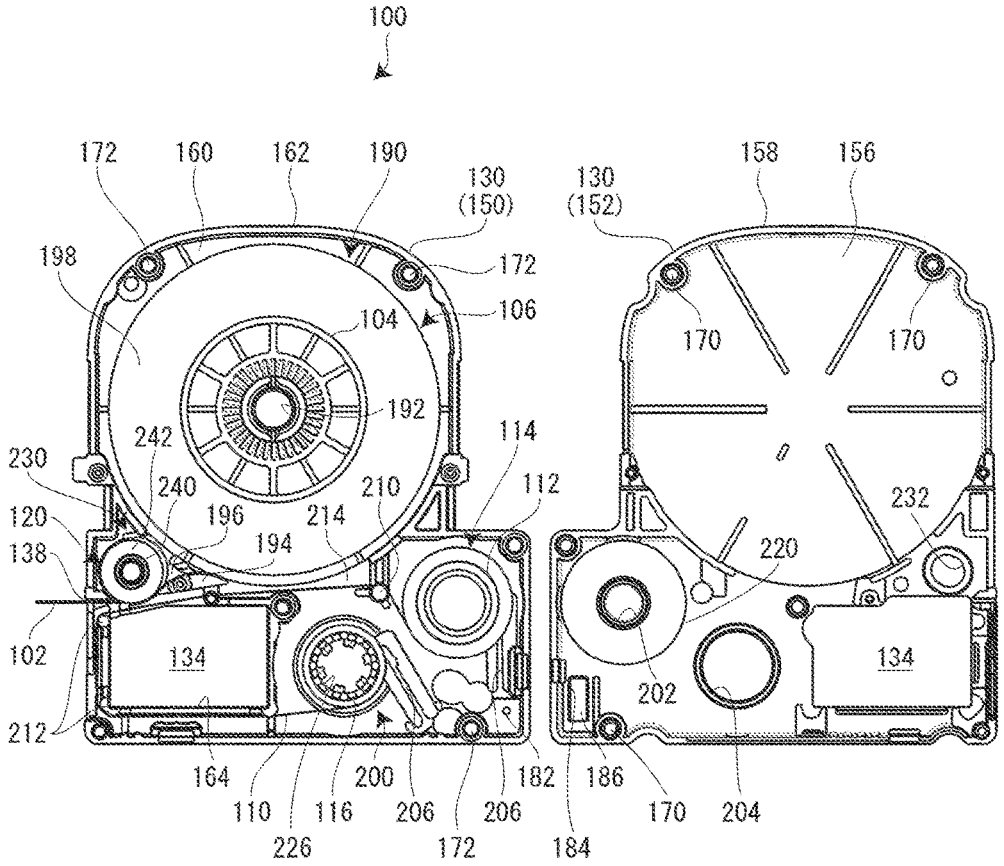
FIGS. 5A and 5B are, respectively, a plan view of the tape cartridge with its upper casing removed and a back view of the upper casing.

As illustrated in FIGS. 5A and 5B, in upper side space (on the side of the tip end surface) inside the cartridge casing 130, a tape accommodation area 190 in which the tape roll 106 is widely accommodated is constituted. At the center of the tape accommodation area 190, the core shaft 192 integrally formed (molded) with the lower casing 150 is provided to stand. The core shaft 192 is formed in a cylindrical shape, and the tape roll 106 (the tape core 104) is rotatably journaled in the outer peripheral surface 192*b* of the core shaft. In the tape accommodation area 190, a tape guide 194 that guides the fed-out printing tape 102 to the platen roller 120 is integrally formed with the lower casing 150 so as to stand in the vicinity of the platen roller 120.

That is, inside the cartridge casing 130, a tape feeding path. 196 ranging from the tape roll 106 as a starting point to the tape delivering port 138 through the tape guide 194 and the platen roller 120 is constituted. The printing tape 102 fed out from the tape roll 106 is guided to the platen roller 120 through the tape guide 194 and subjected to printing by the platen roller 120. Then, the printing tape is further guided from the platen roller 120 to the tape delivering port 138.

The tape roll 106 includes two circular films 198 affixed to both end surfaces of the roll-like printing tape 102, besides the printing tape 102 and the tape core 104. The two circular films 198 prevent the printing tape 102 wound on the tape core 104 from spreading out. In addition, although not illustrated in the drawings, reverse-rotation stop mechanism is embedded in the to core 104. When the tape cartridge 100 is carried, the reverse rotation of the printing tape 102 is prevented by the reverse-rotation stop mechanism. On the other hand, when the tape cartridge 100 is installed on the cartridge installation portion 5 of the tape printing apparatus 1, the reverse-rotation stop of the reverse-rotation stop mechanism is released by the positioning projection 41, whereby the feeding of the printing tape 102 is made possible.

On the right side of a base portion inside the cartridge casing 130, a ribbon accommodation area 200 is constituted adjacent to the insertion opening 134. In the ribbon accommodation area 200, a feeding-out-side bearing portion 202 that rotatably supports the ribbon roll 114 (the feeding-out core 112) and a winding-up-side bearing portion 204 that rotatably supports the winding-up core 116 are integrally formed with the cartridge casing 130 on the right and left parts, respectively. That is, the feeding-out-side bearing portion 202 and the winding-up-side bearing portion 204 are formed on each of the upper casing 152 and the lower casing 150.

The notched parts of the feeding-out-side bearing portion 202 and the winding-up-side bearing portion 204 formed on the lower casing 150 are each integrally formed with the rotation-stop hooks 206 having the tip end thereof facing the feeding-out-side bearing portion 202 and the winding-up-side bearing portion 204. Further, one and the other of rotation-stop hooks 206 engage with the feeding-out core 112 and the winding-up core 116, respectively, in their rotation stopping state.

In the ribbon accommodation area 200, a first ribbon guide 210 that guides the fed-out ink ribbon 110 to the platen roller 120 is integrally formed with the lower casing 150 so as to stand in the vicinity of the feeding-out-side bearing portion 202. In addition, on the outer peripheral side of the opening peripheral wall portion 164, a plurality of second ribbon guides 212 that guides the going-around of the ink ribbon 110 is integrally formed.

That is, inside the cartridge casing 130, a ribbon feeding path 214 ranging from the ribbon roll 114 as a starting point to the winding-up core 116 through the first ribbon guide 210, the platen roller 120, and the plurality of second ribbon guides 212 is constituted. The ink ribbon 110 fed out from the ribbon roll 114 is guided to the platen roller 120 through the first ribbon guide 210 and subjected to printing by the platen roller 120. Moreover, the ink ribbon 110 goes around the opening peripheral wall portion 164 (the plurality of second ribbon guides 212) through the platen roller 120 and is wound up by the winding-up core 116.

The ribbon roll 114 includes a circular leaf spring 220 that applies a braking load to the feeding-out core 112, besides the ink ribbon 110 and the feeding-out core 112 (see FIG. 5B). The leaf spring 220 is formed to be wavy in the peripheral direction and interposed between the top wall portion 156 of the upper casing 152 and the feeding-out core 112 in the shaft direction. That is, a rotation braking load is applied to the feeding-out core 112 by the elastic force of the leaf spring 220. Thus, back tension is applied to the ink ribbon 110 fed out from the winding-up core 116 to prevent slack in the ink ribbon 110.

The feeding-out core 112 is formed in a cylindrical shape, and a plurality of notches 222 is formed in the peripheral direction at the end thereof on the side of the lower casing 150 (see FIG. 6). Further, the rotation-stop hooks 206 engage with or disengage from the plurality of notches 222. Note that the feeding-out-side bearing portion 202 on the side of the lower casing 150 supporting the feeding-out core 112 is constituted of a circular opening while the feeding-out-side bearing portion 202 on the side of the upper casing 152 is constituted of a cylindrical projection portion. Further, the leaf spring 220 is attached to the projection portion (see FIG. 5B about both of them).

Similarly, the winding-up core 116 is formed in a cylindrical shape, and a plurality of notches 224 is formed in the peripheral direction at the end thereof on the side of the lower casing 150. Further, the rotation-stop hooks 206 engage with or disengage from the plurality of notches 224. In addition, a spline groove 226 is formed on the inner peripheral surface of the winding-up core 116 and spline-engages with the winding-up driving shaft 47. Thus, the rotation force of the winding-up driving shaft 47 is transmitted to the winding-up core 116 to wind up the ink ribbon 110.

On the left side of the base portion inside the cartridge casing 130, a platen accommodation area 230 is constituted adjacent to the insertion opening 134. At the center of the platen accommodation area 230, a lower bearing portion 234 (see FIG. 6) having an elliptical opening formed on the lower casing 150 and an upper bearing portion 232 (see FIG. 5B) having an elliptical opening formed on the upper casing 152 are provided. Further, by the upper bearing portion 232 and the lower bearing portion 234, the platen roller 120 is supported so as to be rotatable and slightly horizontally movable. That is, the platen roller 120 supported by the elliptical upper bearing portion 232 and the lower bearing portion 234 is configured to be horizontally movable (slightly movable) between a home position at which the platen roller 120 engages with the platen driving shaft 45 and a holding position at which the platen roller 120 comes in contact with the tape guide 194 with the printing tape 102 held therebetween.

Meanwhile, when the tape cartridge 100 is carried, the fed-out end of the printing tape 102 is in a state of slightly projecting from the delivered 138 to an outside (see FIG. 1). If a pressing force or a withdrawing force is falsely applied to the fed-out end of the printing tape 102 at this time, the platen roller 120 pulled by the force is moved to the holding position described above. Thus, the fed-out end of the printing tape 102 is prevented from being withdrawn into the cartridge casing 130 through the delivered 138.

The platen roller 120 includes a cylindrical roller base body 240 and a rubber roller 242 attached to the outer peripheral surface of the roller base body 240. The rubber roller 242 has a length corresponding to the printing head 21 in the shaft direction, and the printing head 21 comes in contact with the rubber roller 242 with the printing tape 102 and the ink ribbon 110 held therebetween when moving to a printing position. In addition, a spline groove 244 is formed on the inner peripheral surface of the roller base body 240 and spline-engages with the rotation driving shaft 49 of the platen driving shaft 45. Thus, the rotation force of the platen driving shaft 45 is transmitted to the platen roller 120 to print-feed the printing tape 102 (and the ink ribbon 110).

Surrounding Displacement Portion According to First Embodiment

Referring to FIGS. 7A to 7C, a structure of a displacement portion 186 of a tape cartridge 100 according to a first embodiment will be described in detail below in conjunction with a structure of the detection-target projection 83 (detection-target element) of the opening/closing cover 7 and the detection element 52*b* of the cover detection portion 52 (detection portion). As described above, the displacement portion 186 (elastic portion) is provided at a right corner on the base end surface of the top wall portion 156 of the upper casing 152. In addition, the detection-target projection 83 corresponding to the displacement portion is provided so as to protrude from the rear surface of the opening/closing cover 7 (opening/closing cover body 73), and the detection element 52*b* of the cover detection portion 52 is disposed so as to protrude from the installation base 31 of the cartridge installation portion 5.

As illustrated in FIGS. 7A to 7C, the displacement portion 186 includes an elastic piece 310 having an "L"-shaped cross section extending from the top wall portion 156 of the upper casing 152 to the inner side. As described above, the top wall portion 156 is formed with the accommodation opening 184 that accommodates the detection-target projection 83, and the bottom wall portion 160 is formed with the insertion opening 182 into which the detection element 52*b* is inserted.

The elastic piece 310 includes a suspended piece 316 extending from the top wall portion 156 and a contact piece 318 on which the detection-target projection 83 is abutted (contacted), and is formed (molded) integrally with the upper casing 152. The elastic piece 310 is elastically deformed by pressing of the detection-target projection 83 so that the detection element 52*b* is operated (the cover detection portion 52 is turned ON) and the tape cartridge 100 is relatively pressed against the installation base 31 and is positioned in the installation direction.

The elastic piece 310 (contact piece 318) is formed in a rectangular shape when viewed in a plan, and the accommodation opening 184 is formed in a rectangular shape having a size larger than that of the elastic piece 310. In addition, the elastic piece 310 (contact piece 318) is parallel to the right side of the upper casing 152, and extends to the base end from the tip end of the upper casing 152. When a pressing force of the detection-target projection 83 acts on the elastic piece 310, the contact piece 318 is bent downward, the suspended piece 316 is bent backward, and thus an elastic force (spring force) is exerted.

As illustrated in FIG. 7C, the elastic piece 310 is displaced by the pressing force of the detection-target projection 83 when the opening/closing cover 7 is closed, and gives a reaction force, which increases (preferably, proportionally increases) in accordance with the displacement amount to the detection-target projection 83. In other words, when the detection-target projection 83 is received, the tape cartridge 100 is pressed against the installation base 31 by its own elastic piece 310. For this reason, the elastic force of the elastic piece 310 is designed such that the tape cartridge 100 is positioned in the installation base 31 in the installation direction.

More specifically, the tape cartridge 100 receives the pressing force of the printing head 21 through the platen roller 120, and receives a rotation force around the platen roller 120 or the winding-up core 116 with a rotation of the platen roller 120 (platen driving shaft 45) or the winding-up core 116 (winding-up driving shaft 47). Therefore, the tape cartridge 100 receives the resultant of the pressing force and the rotation force and component forces thereof, and thus positional deviation or floating occurs on the installation base 31. The elastic force of the elastic piece 310 according to the embodiment allows the tape cartridge 100 to be installed at a predetermined position against the resultant and the component forces.

As described above, a plurality of types of tape cartridges having a different thickness are available as the tape cartridge 100. Therefore, among the tape cartridges 100 having a different thickness, the contact piece 318 of the elastic piece 310 is preferably disposed such that the position thereof becomes the same in a vertical direction illustrated in FIG. 7C. Thus, the detection element 52*b* can be reliably operated in the tape cartridges 100 having a different thickness.

On the other hand, as illustrated in FIG. 7B, the detection-target projection 83 is formed in a "T"-shape in cross section and vertically projects from the rear surface of the opening/closing cover body 73. The opening/closing cover body 73 and the detection-target projection 83 are integrally molded by a resin or the like, and the "T"-shape in cross section of the detection-target projection 83 prevents a molding failure (sink mark). The detection-target projection 83 having the "T"-shape in cross section is disposed with the flange piece 95 directed to the side of the tip end of the opening/closing cover body 73 and the rib piece 97 directed to the side of the base end of the opening/closing cover body 73. Further, the tip end of the detection-target projection 83 is formed in a slant surface following the shape of the deformed elastic piece 310, and the entirety of the tip end presses the elastic piece 310.

As illustrated in FIG. 7C, the detection element 52*b* of the cover detection portion 52 is disposed immediately below the detection-target projection 83 with the contact piece 318 sandwiched therebetween. More specifically, the detection element 52*b* is disposed coaxially with the detection-target projection 83 in a state where the opening/closing cover 7 is closed. In addition, the tip end of the detection element 52*b* comes in contact with the lower surface (rear surface) of the contact piece 318, or is positioned to face the detection element with a small clearance. When the pressing force of the detection-target projection 83 acts on the elastic piece 310, the contact piece 318 is bent downward and the detection element 52*b* is pressed down at the same time, so that the detection portion body 52*a* of the cover detection portion 52 is operated (turned ON). Thus, it is detected that the opening/closing cover 7 closes the cartridge installation portion 5.

As described above, according to the tape cartridge 100 of the first embodiment, the detection-target projection 83 elastically deforms the elastic piece 310 when the opening/closing cover 7 is closed, and further presses down the detection element 52*b* through the elastic piece 310. Thus, the tape cartridge 100 is pressed against the installation base 31 (cartridge installation portion 5) through the elastic piece 310 by the detection-target projection 83, thereby being positioned. At the same time, the cover detection portion 52 is operated by the pressing of the detection element 52*b*, and the closing of the opening/closing cover 7 is detected.

In the tape cartridge 100 according to the first embodiment, the cover detection portion 52 is operated through the displacement portion 186 (elastic piece 310). For this reason, it is possible to detect not only the opening/closing of the opening/closing cover 7 but also the presence or absence of the tape cartridge 100. Accordingly, due to the tape detection portion 51, it is not necessary to separately detect the presence or absence of the tape cartridge 100. In addition, since the detection element 52*b* is pressed down by the displacement portion 186 (elastic piece 310) to be elastically deformed, it is possible to prevent the positional deviation of the tape cartridge 100 with a simple structure.

Furthermore, the cover detection portion 52 can be disposed inside the cartridge installation portion 5, and accordingly, it is not necessary to make the size of the opening/closing cover 7 large. In the cartridge installation portion 5, it is possible to improve the degree of freedom of installation of the cover detection portion 52. Both side surfaces of the detection-target projection 83 can come in contact with both sides of the accommodation opening 184, and the tape cartridge 100 can be positioned through the accommodation opening 184 in the lateral direction. In addition, the contact piece 318 according to the above-described embodiment is formed in a simple rectangular shape, but the shape thereof may be arbitrary, for example, a key hole shape.

Modification Example of First Embodiment

Figure 8A:
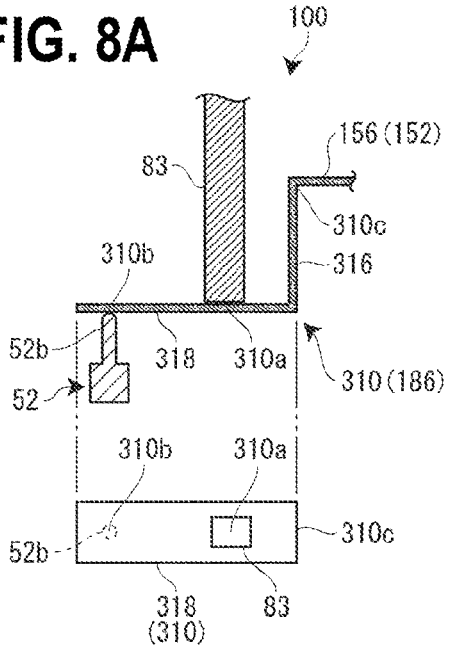
FIGS. 8A, 8B, 8C, and 8D are, respectively, a structural view of a surrounding displacement portion of a tape cartridge according to a first modification example of the first embodiment, a structural view of a surrounding displacement portion of a tape cartridge according to a second modification example, a structural view of a surrounding displacement portion of a tape cartridge according to a third modification example, and a structural view of a surrounding displacement portion of a tape cartridge according to a fourth modification example.
Figure 8B:
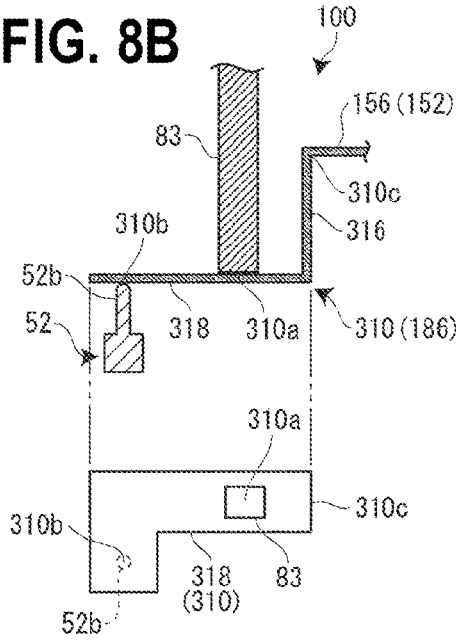
Figure 8C:
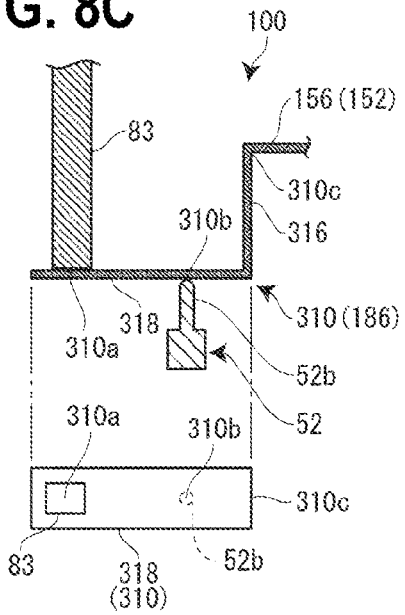
Figure 8D:
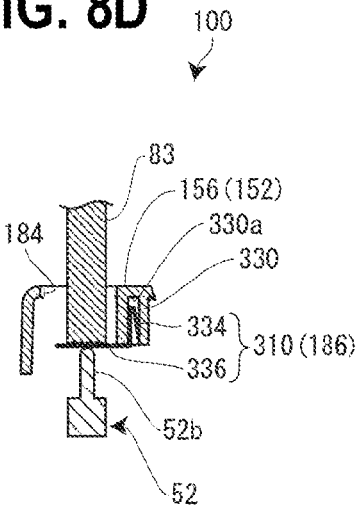

Tape cartridges 100 according to modification examples of the first embodiment will be described below with reference to FIGS. 8A and 8D. FIG. 8A illustrates a first modification example, FIG. 8B illustrates a second modification example, FIG. 8C illustrates a third modification example, and FIG. 8D illustrates a fourth modification example.

In the tape cartridge 100 according to the first modification example, as illustrated in FIG. 8A, a contact piece 318 of an elastic piece 310 extends long toward a tip so as to press down a detection element 52*b* at a tip end of the contact piece 318. That is, an axial line of a detection-target projection 83 and an axial line of the detection element 52*b* are positionally deviated from each other in a forward and backward direction (tip end—base end direction). This means that a position where the detection-target projection 83 contacts with a displacement input portion to be displaced by the detection-target projection 83 provided on an opening/closing cover 7 is positionally deviated from a position where a detection element contacts with a displacement output portion for actuating the detection element of a detection target 180 when viewed from a detachable direction.

Specifically, in a plane parallel to an installation base 31 (as viewed from the installation direction of the tape cartridge 100), an input part 310*a* where the detection-target projection 83 contacts with the elastic piece 310 (contact piece 318) is positionally deviated from an output part 310*b* where the elastic piece 310 (contact piece 318) contacts with the detection element 52*b* in the forward and backward direction. In addition, compared to a distance from a support part 310*c* of an upper casing 152 serving as a base of the elastic piece 310 (suspended piece 316) to the input part 310*a*, a distance from the support part 310*c* to the output part 310*b* becomes longer in the forward and backward direction.

In such a configuration, since the vicinity of the support part 310*c* approximately serves as a center of rotational displacement, the detection element 52*b* can be actuated with a relatively small displacement amount of the elastic piece 310 using the principle of leverage. In other words, even when an actuation stroke of the detection element 52*b* is large, the detection element can be reliably actuated.

In the tape cartridge 100 according to the second modification example, as illustrated in FIG. 8B, a tip end of a contact piece 318 is formed in an "L" shape, and a detection element 52*b* is positionally deviated from a detection-target projection 83 not only in the forward and backward direction but also in the lateral direction. For example, an installation space of a cover detection portion 52 is limited, and thus the plane shape (for example, the tip end) of the contact piece 318 is configured to be freely deformed so as to match the position of the detection element 52*b*. In this way, even when the position of the detection-target projection 83 is positionally deviated from the position of the detection element 52*b* in the forward and backward direction and the lateral direction, the detection element 52*b* can be properly actuated.

In the tape cartridge 100 according to the third modification example different from the first modification example, as illustrated in FIG. 8C, compared to a distance from a support part 310*c* serving as a base of an elastic piece 310 (suspended piece 316) to an input part 310*a*, a distance from the support part 310*c* to an output part 310*b* becomes shorter in the forward and backward direction. In this case, a detection element 52*b* can be actuated with a relatively small displacement amount of the elastic piece 310 using the principle of leverage.

In the tape cartridge 100 according to the fourth modification example, as illustrated in FIG. 8D, an elastic piece 310 (displacement portion 186) is configured with a plate spring, and is held in a holding portion 330 provided in an upper casing 152. The elastic piece 310 includes a base spring piece portion 334 bent in a "V" shape and a contact spring piece portion 336 extending parallel to a top wall portion 156 from the base spring piece portion 334, and is held in a holding groove 330*a*, which is formed in the holding portion 330, by the base spring piece portion 334.

Even in such a configuration, it is also possible to detect the opening/closing of the opening/closing cover 7 and the presence or absence of the tape cartridge 100. In addition, the positioning of the tape cartridge 100 can be achieved. Particularly, since the elastic piece 310 is prepared depending on the thickness of the tape cartridge 100, it is possible to correspond to the tape cartridges 100 having different thicknesses.

Surrounding Displacement Portion According to Second Embodiment

Figure 9:
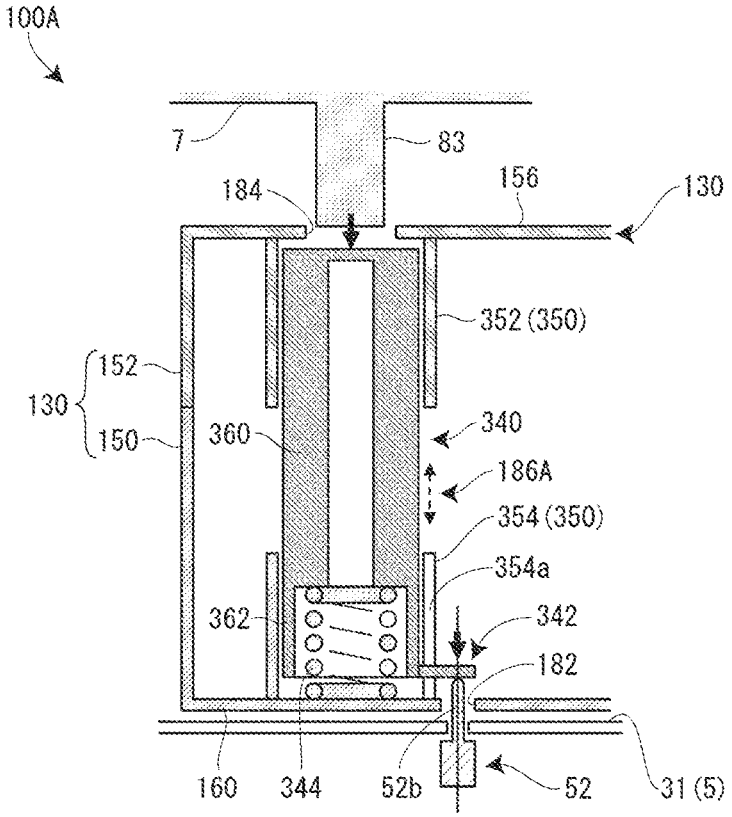
FIG. 9 is a cross-sectional view of a surrounding displacement portion of a tape cartridge according to a second embodiment.

Referring to FIG. 9, a structure of a displacement portion 186A of a tape cartridge 100A according to a second embodiment will be described in detail below in conjunction with a structure of the detection-target projection 83 of the opening/closing cover 7 and the detection element 52*b* of the cover detection portion 52. In the second embodiment, differences from the first embodiment will mainly be described.

In the tape cartridge 100A according to the second embodiment, as illustrated in FIG. 9, the displacement portion 186A is disposed immediately below the detection-target projection 83, and the detection element 52*b* is disposed at a position separated from immediately below the detection-target projection 83 to the front (tip end). The displacement portion 186A includes an input portion 340 coming in contact with the detection-target projection 83, an output portion 342 that is provided at the base of the input portion 340 and presses down the detection element 52*b*, and an elastic member 344 that receives the input portion 340 and the output portion 342 at an initial position at which the detection-target projection 83 is received.

In addition, a cartridge casing 130 is provided with a slide guide 350 that guides movement of the input portion 340 in a vertical direction (thickness direction of the tape cartridge 100A). The slide guide 350 includes an upper guide 352 suspended integrally with an upper casing 152 and a lower guide 354 erected integrally with a lower casing 150. The lower guide 354 is provided with a guide notch portion 354*a* facing the output portion 342.

The input portion 340 includes a cylindrical input portion body 360 and a skirt portion 362 connected to a lower end of the input portion body 360. Then elastic member 344 configured with a coil spring is disposed inside the skirt portion 362, and the output portion 342 is provided at an outer surface of the lower end of the skirt portion 362 so as to protrude in a radial direction. The input portion body 360, the skirt portion 362, and the output portion 342 are integrally formed (molded) with resin or the like. The detection element 52*b* comes in contact with a lower surface of the output portion 342.

The elastic member 344 configured with the coil spring is seated on a bottom wall portion 160 of the lower casing 150, and receives the input portion 340. The elastic member 344 is configured with a compression coil spring, and, as illustrated in the drawing, receives the input portion 340 at an initial position where the upper end of the input portion is kept in the minute clearance with the upper casing 152 (top wall portion 156) or faces to abut on the upper casing.

When the detection-target projection 83 presses the input portion 340, the input portion 340 and the output portion 342 moves down against the elastic member 344, and the output portion 342 presses down the detection element 52*b*. In addition, the detection-target projection 83 deviates upward, the input portion 340 and the output portion 342 returns to the original initial position by the elastic member 344.

Thus, even in the tape cartridge 100A according to the second embodiment, the cover detection portion 52 is operated (turned ON) through the displacement portion 186A. Therefore, it is possible to detect not only the opening/closing of the opening/closing cover 7 but also the presence or absence of the tape cartridge 100A. In addition, the elastic member 344 of the displacement portion 186 relatively presses the tape cartridge 100A to make the positioning of the tape cartridge possible.

Modification Example of Second Embodiment

Figure 10A:
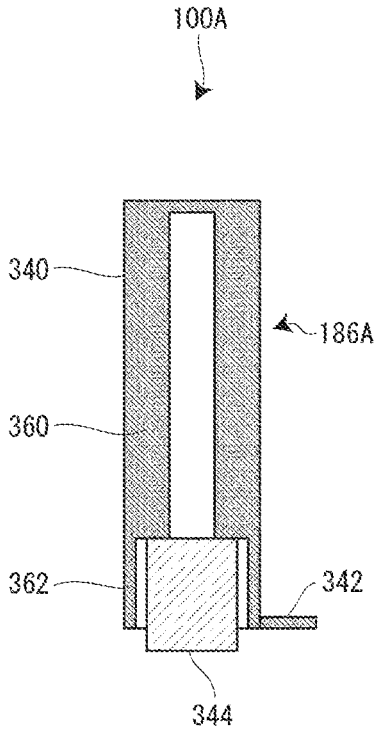
FIGS. 10A and 10B are, respectively, a cross-sectional view of a surrounding displacement portion of a tape cartridge according to a first modification example of the second embodiment and a cross-sectional view of a surrounding displacement portion of a tape cartridge according to a second modification example.
Figure 10B:
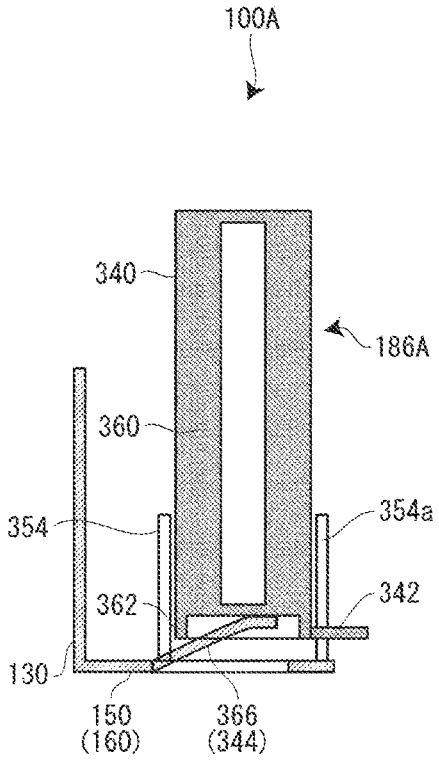

Referring to FIGS. 10A and 10B, tape cartridges 100A according to modification examples of the second embodiment will be described below. FIG. 10A illustrates a first modification example, and FIG. 10B illustrates a second modification example.

In the tape cartridge 100A illustrated in FIG. 10A according to the first modification example, an elastic member 344 is configured with rubber or sponge instead of the coil spring.

In the tape cartridge 100A illustrated in FIG. 10B according to the second modification example, an elastic member 344 is made up of a spring piece 366 configured in such a manner that a bottom wall portion 160 of a lower casing 150 is cut and raised inward. In this case, a skirt portion 362 of an input portion 340 is formed shorter, and the spring piece 366 receives the input portion 340 at a lower end of an input portion body 360.

Thus, in the tape cartridges 100A according to the modification examples of the second embodiment, the elastic member 344 can simply be configured. In particular, according to the second modification example, it is possible to reduce the number of parts of the tape cartridge 100A.

Surrounding Displacement Portion According to Third Embodiment

Figure 11:
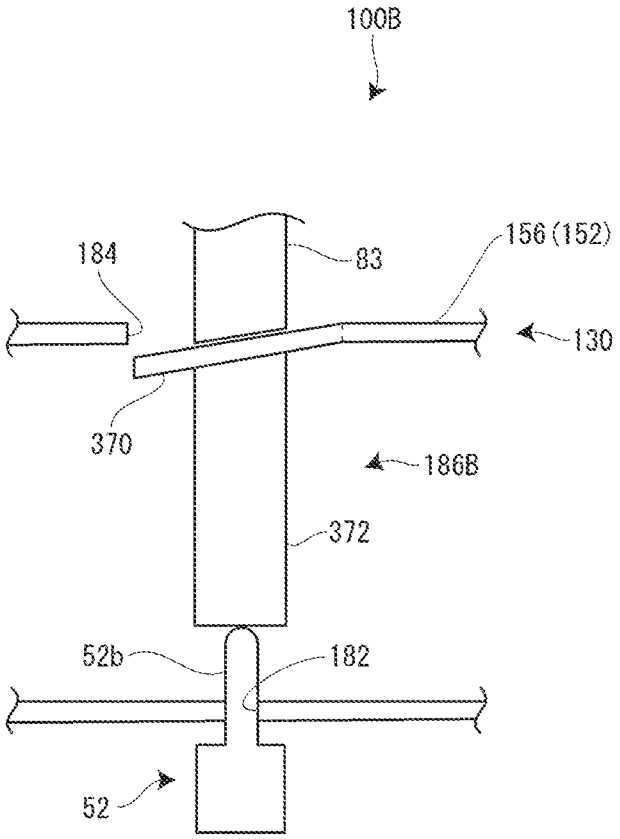
FIG. 11 is a cross-sectional view of a surrounding displacement portion of a tape cartridge according to a third embodiment.

Referring to FIG. 11, a structure of a displacement portion 186B of a tape cartridge 100B according to a third embodiment will be described in detail below in conjunction with a structure of a detection-target projection 83 of an opening/closing cover 7 and a detection element 52*b* of a cover detection portion 52. In the third embodiment, differences from the first embodiment will mainly be described.

In the tape cartridge 100B according to the third embodiment, as illustrated in FIG. 11, the displacement portion 186B includes an input elastic portion 370 that is elastically deformed by a pressing force of the detection-target projection 83 and an output actuation portion 372 that is continuous to the input elastic portion 370 and actuates the detection element 52*b* in accordance with the elastic deformation of the input elastic portion 370.

The input elastic portion 370 is formed in such a manner that a part of a top wall portion 156 is removed in a "U" shape. The output actuation portion 372 is formed in a rod shape, and is fixed to the lower surface of the input elastic portion 370. When the detection-target projection 83 presses the input elastic portion 370, the input elastic portion 370 is elastically deformed and the output actuation portion 372 moves downward at the same time. The output actuation portion 372 moving downward presses down the detection element 52*b*.

Thus, even in the tape cartridge 100B according to the third embodiment, the cover detection portion 52 is operated (turned ON) through the displacement portion 186B. Therefore, it is possible to detect not only the opening/closing of the opening/closing cover 7 but also the presence or absence of the tape cartridge 100B. In addition, the input elastic portion 370 of the displacement portion 186B relatively presses the tape cartridge 100B to make the positioning of the tape cartridge possible.

Surrounding Displacement Portion According to Fourth Embodiment

Figure 12:
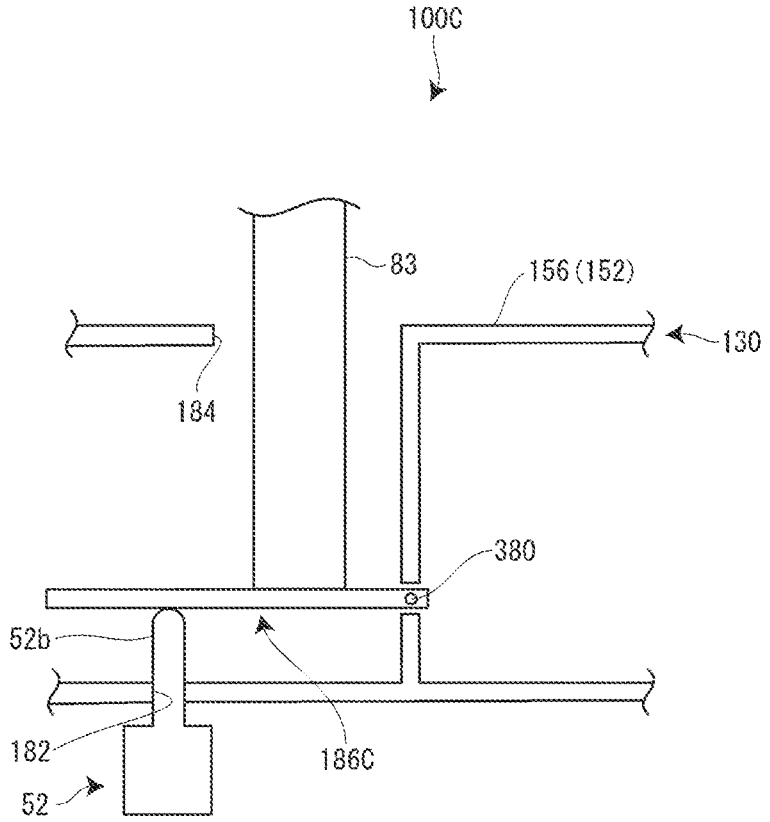
FIG. 12 is a cross-sectional view of a surrounding displacement portion of a tape cartridge according to a fourth embodiment.

Referring to FIG. 12, a structure of a displacement portion 186C of a tape cartridge 100C according to a fourth embodiment will be described in detail below in conjunction with a structure of a detection-target projection 83 of an opening/closing cover 7 and a detection element 52*b* of a cover detection portion 52. In the fourth embodiment, differences from the first embodiment will mainly be described.

In the tape cartridge 100C according to the fourth embodiment, as illustrated in FIG. 12, the displacement portion 186C is formed in a rectangular plate shape, and is rotatably supported to a rotating support portion 380 provided in a cartridge casing 130. The upper surface of the displacement portion 186C comes in contact with the detection-target projection 83, and the lower surface thereof comes in contact with the detection element 52*b*. When the detection-target projection 83 presses the plate-like displacement portion 186C, the displacement portion 186C rotates to press down the detection element 52*b*.

Thus, even in the tape cartridge 100C according to the fourth embodiment, the cover detection portion 52 is operated (turned ON) through the displacement portion 186C. Therefore, it is possible to detect not only the opening/closing of the opening/closing cover 7 but also the presence or absence of the tape cartridge 100C. In order to relatively press the tape cartridge 100C and make the positioning of the tape cartridge possible, a torsion coil spring may be provided on a rotation shaft of the displacement portion 186C.

The invention claimed is:

1. A tape cartridge installed detachably on a cartridge installation portion of a tape printing apparatus in a predetermined detachable direction, the tape printing apparatus including a detection portion which detects closing of an opening/closing cover provided on the cartridge installation portion, the tape cartridge comprising:

a displacement input portion;

a displacement output portion, and a displacement portion that includes the displacement input portion and the displacement output portion, wherein when the opening/closing cover is displaced from an open state to a closed state in a state where the tape cartridge is installed on the cartridge installation portion, the displacement input portion receives displacement of a detection-target element, which is provided on the opening/closing cover, to be displaced according to the displacement of the opening/closing cover from the open state to the closed state, and the displacement output portion actuates a detection element of the detection portion according to displacement of the opening/closing cover to be further displaced in the same direction from the open state to the closed state, and the displacement portion has an elastic portion that is subjected to elastic deformation by a pressing force of the detection-target element and actuates the detection element by the elastic deformation.

2. The tape cartridge according to claim 1, further comprising:

a cartridge casing that has a shell structure;

an accommodation opening that is provided in the cartridge casing and accommodates the detection-target element; and an insertion opening that is provided in the cartridge casing and into which the detection element is inserted, wherein the displacement input portion and the displacement output portion are disposed inside the cartridge casing.

3. The tape cartridge according to claim 2, wherein the displacement portion includes:

an input portion that moves by a pressing force of the detection-target element; and an output portion that is continuous to the input portion and actuates the detection element according to movement of the input portion.

4. The tape cartridge according to claim 1, wherein a position of the displacement input portion coming in contact with the detection-target element is positionally deviated from a position of the displacement output portion coming in contact with the detection element when viewed in the detachable direction.

5. The tape cartridge according to claim 3, wherein the displacement portion further includes an elastic member that receives the input portion at an initial position at which the detection-target element is received.

6. The tape cartridge according to claim 5, wherein the elastic member is configured with a coil spring.

7. The tape cartridge according to claim 5, wherein the elastic member is configured with either one of rubber and sponge.

8. The tape cartridge according to claim 5, wherein the elastic member is a casing piece formed in such a manner that a part of a casing wall of the cartridge casing is cut and raised toward the input portion.

9. The tape cartridge according to claim 3, wherein the input portion and the output portion are integrally formed.

10. The tape cartridge according to claim 4, wherein the displacement portion is displaced substantially around a support point, and a distance from the support point to the position of the displacement output portion coming in contact with the detection element is longer than a distance from the support point to the position of the displacement input portion coming in contact with the detection-target element.

11. The tape cartridge according to claim 10, wherein the displacement portion includes:

an input elastic portion that is subjected to elastic deformation by a pressing force of the detection-target element; and an output actuation portion that is continuous to the input elastic portion and actuates the detection element according to the elastic deformation of the input elastic portion.

12. The tape cartridge according to claim 11, further comprising:

a cartridge casing that has a shell structure, wherein the input elastic portion is formed by removing a part of a casing wall of the cartridge casing.

13. The tape cartridge according to claim 12, wherein the input elastic portion is formed by removing a part of a casing wall in a "U" shape.

14. The tape cartridge according to claim 4, wherein the displacement portion is displaced substantially around a support point, and a distance from the support point to the position of the displacement output portion coming in contact with the detection element is shorter than a distance from the support point to the position of the displacement input portion coming in contact with the detection-target element.

15. The tape cartridge according to claim 1, wherein the elastic portion includes an elastic piece that comes in contact with the detection-target element and extends toward the detection element in an "L" shape.

16. The tape cartridge according to claim 15, further comprising:

a cartridge casing that has a shell structure, wherein the elastic piece is formed integrally with the cartridge casing.

17. The tape cartridge according to claim 15, further comprising:

a cartridge casing that has a shell structure, wherein the elastic piece is configured with a plate spring supported on the cartridge casing.

18. The tape cartridge according to claim 1, further comprising:

a cartridge casing that has a shell structure, wherein the cartridge casing has two casing, and the displacement portion is provided on either one of the two casing.

* * * * *